US009708773B2

(12) United States Patent
Blake et al.

(10) Patent No.: US 9,708,773 B2
(45) Date of Patent: Jul. 18, 2017

(54) SECURITY SHEET OR DOCUMENT HAVING ONE OR MORE ENHANCED WATERMARKS

(71) Applicants: Crane & Co., Inc., Boston, MA (US); Crane Security Technologies, Inc., Nashua, NH (US); Crane AB, Tumba (SE)

(72) Inventors: William Blake, Great Barrington, MA (US); Jeffrey Boody, Dalton, MA (US); Kraig M. Brigham, Lenox, MA (US); James Callahan, Dalton, MA (US); Paul F. Cote, Hollis, NH (US); Michael Darroch, Dalton, MA (US); Manish Jain, Pittsfield, MA (US); Karin Mörck Hamilton, Stockholm (SE); Giles D. Prett, Dalton, MA (US)

(73) Assignees: Crane & Co., Inc., Boston, MA (US); Crane Security Technologies, Inc., Nashua, NH (US); Crane AB, Tumba (SE)

( * ) Notice: Subject to any disclaimer, the term of this patent is extended or adjusted under 35 U.S.C. 154(b) by 191 days.

(21) Appl. No.: 14/558,508

(22) Filed: Dec. 2, 2014

(65) Prior Publication Data

US 2015/0152602 A1 Jun. 4, 2015

Related U.S. Application Data

(63) Continuation-in-part of application No. 12/997,390, filed on Feb. 23, 2011, now abandoned.

(Continued)

(51) Int. Cl.

| | |
|---|---|
| ***D21H 21/44*** | (2006.01) |
| ***D21H 17/20*** | (2006.01) |
| ***B42D 25/333*** | (2014.01) |

(52) U.S. Cl.
CPC ..... *D21H 21/44* (2013.01); *B42D 25/333* (2014.10); *D21H 17/20* (2013.01)

(58) Field of Classification Search
USPC ..... 162/140, 158
See application file for complete search history.

(56) References Cited

U.S. PATENT DOCUMENTS

| | | | |
|---|---|---|---|
| 4,437,935 | A | 3/1984 | Crane, Jr. |
| 4,462,867 | A | 7/1984 | Fuller |

(Continued)

FOREIGN PATENT DOCUMENTS

| | | |
|---|---|---|
| CA | 2123846 | 12/1994 |
| CA | 2122528 | 2/2007 |

(Continued)

OTHER PUBLICATIONS

Fabritius et al, "Determination of the refractive index of paper with clearing agents", Intl. Conf. on Lasers, Applications, and Technologies 2005: High-Power Lasers and Applications, (2006), [online],retrieved from the Internet, [retrieved Sep. 9, 2016], <URL: http://proceedings.spiedigitallibrary.org/proceeding.aspx?articleid=727437>.*

(Continued)

*Primary Examiner* — Dennis Cordray
(74) *Attorney, Agent, or Firm* — Holland & Bonzagni, P.C.; Mary R. Bonzagni, Esq.

(57) ABSTRACT

The invention generally relates to a security sheet or document having one or more enhanced watermarks. In one exemplary embodiment, the inventive security sheet or document is a single-ply paper that is made up of a paper layer including one or more watermarks, and a micro-optic security device (e.g., a patch or thread) that at least partially covers an upper or face portion of the watermark(s). The overlying patch or thread increases the durability of the (Continued)

watermark(s), thereby allowing for the watermark(s) as well as reduced fiber density areas therein to be made larger, and further allowing for the reduced fiber density areas to be made thinner. In a preferred embodiment, the micro-optic security device projects one or more synthetic images that coordinate or link in with the watermark design(s). In a more preferred embodiment, the micro-optic security device offers a machine detectable/readable feature in the form of enhanced IR-brightness, especially when measured in transmission. As will be readily appreciated, the inventive security sheet or document offers greatly improved counterfeit-resistance.

6 Claims, 10 Drawing Sheets

Related U.S. Application Data

(60) Provisional application No. 61/911,141, filed on Dec. 3, 2013, provisional application No. 61/911,831, filed on Dec. 4, 2013, provisional application No. 61/911,885, filed on Dec. 4, 2013, provisional application No. 61/924,000, filed on Jan. 6, 2014.

(56) References Cited

U.S. PATENT DOCUMENTS

| | | | |
|---|---|---|---|
| 4,754,319 | A | 6/1988 | Saito et al. |
| 5,405,500 | A | 4/1995 | Knight |
| 5,486,022 | A | 1/1996 | Crane |
| 5,567,276 | A | 10/1996 | Boehm et al. |
| 5,574,083 | A | 11/1996 | Brown et al. |
| 5,634,669 | A | 6/1997 | Colgate, Jr. |
| 5,783,275 | A | 7/1998 | Mück et al. |
| 5,989,389 | A | 11/1999 | Sundberg |
| 6,355,140 | B1 | 3/2002 | Murakami et al. |
| 6,438,262 | B1 | 8/2002 | Bernardini et al. |
| 6,447,630 | B1 | 9/2002 | Disano et al. |
| 6,616,803 | B1 | 9/2003 | Isherwood et al. |
| 6,861,388 | B2 | 3/2005 | Ishibashi et al. |
| 7,207,490 | B2 | 4/2007 | Schneider |
| 7,243,951 | B2 | 7/2007 | Cote et al. |
| 7,264,691 | B2 | 9/2007 | Hard |
| 7,333,268 | B2 | 2/2008 | Steenblik et al. |
| 7,347,917 | B2 | 3/2008 | Ash et al. |
| 7,468,842 | B2 | 12/2008 | Steenblik et al. |
| 7,630,954 | B2 | 12/2009 | Adamczyk et al. |
| 7,673,806 | B2 | 3/2010 | Alasia et al. |
| 7,710,551 | B2 | 5/2010 | Hersch et al. |
| 7,738,175 | B2 | 6/2010 | Steenblik et al. |
| 7,808,710 | B2 | 10/2010 | Hansen et al. |
| 7,880,943 | B2 | 2/2011 | Kittler, Jr. et al. |
| 7,931,305 | B2 | 4/2011 | Tompkin et al. |
| 8,083,894 | B2 | 12/2011 | Gruszczynski et al. |
| 8,149,511 | B2 | 4/2012 | Kaule et al. |
| 8,221,586 | B2 | 7/2012 | Haslop |
| 8,363,323 | B2 | 1/2013 | Holmes |
| 8,376,409 | B2 | 2/2013 | Rosset |
| 8,432,589 | B2 | 4/2013 | Tompkin et al. |
| 8,512,518 | B2 | 8/2013 | Garcia Juez et al. |
| 8,840,756 | B2 | 9/2014 | Doublet et al. |
| 2005/0238851 | A1 | 10/2005 | Isherwood et al. |
| 2006/0011449 | A1* | 1/2006 | Knoll ..... G07D 7/026 194/214 |
| 2006/0127649 | A1 | 6/2006 | Keller et al. |
| 2006/0198987 | A1 | 9/2006 | Grob et al. |
| 2007/0164555 | A1 | 7/2007 | Mang et al. |
| 2007/0177131 | A1 | 8/2007 | Hansen |
| 2007/0206249 | A1 | 9/2007 | Phillips et al. |
| 2007/0273143 | A1 | 11/2007 | Crane et al. |
| 2008/0014378 | A1 | 1/2008 | Hoffmuller et al. |
| 2008/0035736 | A1 | 2/2008 | Tompkin et al. |
| 2008/0036193 | A1 | 2/2008 | Golaire et al. |
| 2008/0036194 | A1 | 2/2008 | Golaire et al. |
| 2008/0079257 | A1 | 4/2008 | Fessl |
| 2008/0137160 | A1 | 6/2008 | Wiltshire |
| 2008/0143095 | A1 | 6/2008 | Isherwood et al. |
| 2008/0182084 | A1 | 7/2008 | Tompkin et al. |
| 2008/0202715 | A1 | 8/2008 | Rancien et al. |
| 2008/0216976 | A1 | 9/2008 | Ruck et al. |
| 2009/0008923 | A1 | 1/2009 | Kaule et al. |
| 2009/0162756 | A1 | 6/2009 | Staub et al. |
| 2009/0188638 | A1 | 7/2009 | Chalaye et al. |
| 2010/0001508 | A1 | 1/2010 | Tompkin et al. |
| 2010/0208313 | A1 | 8/2010 | Horgan et al. |
| 2010/0264642 | A1 | 10/2010 | Rosset et al. |
| 2010/0295291 | A1 | 11/2010 | Rancien et al. |
| 2011/0215563 | A1 | 9/2011 | Rancien et al. |
| 2012/0242074 | A1 | 9/2012 | Tamagnini |
| 2013/0003150 | A1 | 1/2013 | Camus et al. |
| 2013/0154250 | A1 | 6/2013 | Dunn et al. |
| 2013/0255896 | A1 | 10/2013 | Doublet |
| 2013/0341902 | A1 | 12/2013 | Eastwood |
| 2014/0332174 | A1 | 11/2014 | Pretsch et al. |

FOREIGN PATENT DOCUMENTS

| | | |
|---|---|---|
| CA | 2569243 | 6/2007 |
| DE | 102007005884 | 8/2008 |
| EP | 0625431 | 11/1994 |
| EP | 1002640 | 5/2000 |
| EP | 1377853 | 1/2004 |
| EP | 1743778 | 1/2007 |
| GB | 2264263 | 8/1993 |
| WO | WO 2005/106601 | 11/2005 |
| WO | WO 2007/076952 | 7/2007 |
| WO | WO 2013/093848 | 6/2013 |

OTHER PUBLICATIONS

Karppinen et al, "Measuring paper wetting processes with laser transmission ", Meas. Sci. Technol. 15 (2004) 1223-1229, [online], retrieved from the Internet, [retrieved Sep. 9, 2016], <URL: http://iopscience.iop.org/article/10.1088/0957-0233/15/7/001/pdf>.*

* cited by examiner

Infra Red Transmitted light

Infra Red Reflected light

Visible spectrum light Reflected

Visible spectrum light transmitted

SECURITY SHEET OR DOCUMENT HAVING ONE OR MORE ENHANCED WATERMARKS

CROSS-REFERENCE TO RELATED APPLICATIONS

This application is a continuation-in-part of U.S. patent application Ser. No. 12/997,390, filed Feb. 23, 2011, and claims benefit of and priority to U.S. Provisional Patent Application No. 61/911,141, filed on Dec. 3, 2013, U.S. Provisional Patent Application No. 61/911,831, filed on Dec. 4, 2013, U.S. Provisional Patent Application No. 61/911,885, filed on Dec. 4, 2013, and U.S. Provisional Patent Application No. 61/924,000, filed on Jan. 6, 2014, each of which is incorporated herein by reference in their entirety.

TECHNICAL FIELD

The invention generally relates to a security sheet or document having one or more enhanced watermarks.

BACKGROUND AND SUMMARY OF THE INVENTION

Security papers are used for manufacturing security documents such as banknotes, passports, postage stamps and the like. Conventionally, a wide variety of security features are incorporated into such security papers or provided on their surface. Known examples of such security features include watermarks, embedded and windowed security threads, fluorescent pigments and the like.

Watermarks, which are recognizable images or patterns in paper that appear as various shades of lightness/darkness when viewed by transmitted light or by reflected light atop a dark background, have provided protection against counterfeiting security documents for hundreds of years. In fact, watermarks and their engaging designs are the most readily recognized security feature available to the general public for the authentication of security documents such as banknotes.

There is, however, an ongoing need to improve the security or counterfeit resistance of watermarked security documents.

The present invention addresses this need by providing enhanced and thus more counterfeit-resistant watermarks in paper and paper-like materials. Specifically, the present invention provides a security sheet or document having one or more enhanced watermarks, the sheet or document comprising:

- a fibrous sheet material including one or more watermarks, wherein each watermark has one or more first regions with reduced fiber densities relative to surrounding regions of the fibrous sheet material and one or more second regions with similar or increased fiber densities relative to surrounding regions of the sheet material, and wherein each watermark has an upper or face portion and a lower or back portion; and
- means for enhancing the one or more watermarks by rendering them visually enhanced, machine detectable/readable, or both, said means selected from the group of:
  - a) one or more film-like or foil-like security elements at least partially covering the face or the back portion of the one or more watermarks, wherein the one or more film-like or foil-like security elements is in the form of a band, strip, stripe, thread, or patch;
  - b) one or more non-film-like, non-foil-like security elements contained on or within either or both the one or more first regions and the one or more second regions of the one or more watermarks, the one or more security elements selected from the group of:
    - i. recognizable or discernible indicia; and
    - ii. one or more substances that are color-imparting and/or machine detectable or machine readable including, but not limited to, ultraviolet (UV) or infrared (IR) reactive, luminescent (i.e., fluorescent or phosphorescent), thermochromic, photochromic, electrochromic, metal, or magnetic security fibers, taggants, planchettes, dyes, pigments;
  - c) one or more polymer or resinous materials contained within the one or more first regions and optionally the one or more second regions of the one or more watermarks, the one or more polymer or resinous materials having an index of refraction or combined (final) index of refraction substantially similar to that of cellulose;
  - d) an optionally windowed second paper layer covering either the face or the back portion of the one or more watermarks; and/or
  - e) one or more transparent or translucent areas surrounding each of the one or more watermarks.

In a first exemplary embodiment, the inventive security sheet or document is a single- or multi-ply paper that comprises:

- a first paper layer including one or more watermarks, each surface of the paper layer displaying either the upper or face portion of the watermark(s) or the lower or back portion thereof;
- one or more film-like or foil-like security elements that at least partially cover the upper or face portion or the lower or back portion of the one or more watermarks; and optionally
- a second paper layer having a reduced basis weight compared to the first paper layer and optionally one or more through windows, the second paper layer covering either the upper or face portion or the lower or back portion of the one or more watermarks.

The film-like or foil-like security element preferably has a color different from the watermark(s) and the surrounding paper thereby enhancing the appearance of the underlying or overlying watermark(s) as well as enhancing the contrast between the underlying or overlying watermark(s) and the surrounding paper.

In one such embodiment, the film-like or foil-like security element(s) is a micro-optic security device that projects one or more synthetic images such as the MOTION™ micro-optic security device, which is described in, for example, U.S. Pat. No. 7,333,268. Such devices display colored images on a transparent or tinted background and thus are well suited for use in combination with underlying printed information. It has been observed that these security devices appear to provide the watermark(s) with a multi-tonal appearance. As will be readily appreciated by those skilled in the art, multi-tonal watermarks present an even greater challenge to a counterfeiter.

In a preferred embodiment, the micro-optic security device is in the form of a surface-applied patch that covers all or part (e.g., one-half) of a watermark, the watermark containing one or more polymer or resinous materials within the first and/or second regions of the watermark, the one or more polymer or resinous materials having an index of refraction or combined (final) index of refraction substantially similar to that of cellulose. In one such embodiment, the region(s) also contains one or more features selected from the group of increased fiber density areas in the form of recognizable or discernible indicia, one or more substances that are color-imparting, and one or more so-called second level security features that are machine detectable or machine readable (e.g., UV or IR reactive, luminescent, thermochromic, photochromic, electrochromic, metal, or magnetic security fibers, taggants, planchettes, dyes, pigments).

As will be readily appreciated by those skilled in the art, the micro-optic security device may also be in the form of a surface-applied elongate security band, strip, stripe, or thread, or a partially embedded elongate security band, strip, stripe, or thread that is present in window regions of a second paper layer (i.e., windowed thread).

Micro-optic devices such as the MOTION™ device may be designed such that when registered with the watermark(s), synthetic images projected thereby are combined with the watermark design(s). For example, in the above-referenced embodiment, the synthetic image(s) generated by each patch may coordinate or link in with the watermark design(s). The synthetic image(s) may also complete the watermark design(s) or locate within the design(s). As will be explained in more detail below, this may be a one-sided or two-sided feature.

In another such embodiment, the micro-optic security device(s), which is also described in, for example, U.S. Pat. No. 7,333,268, displays colored images (of any color, including white and black) on a translucent or substantially opaque background of a different color. In this embodiment, the micro-optic security device(s) at least partially covers and visually camouflages either the upper or face portion of the one or more watermarks, or the lower or back portion of the one or more watermarks. The watermark(s) is not visually discernible in reflected light from the covered side of the paper layer, but is visually evident in reflected light from the uncovered side of the paper layer, and in transmitted light from both sides of the paper layer.

An inherent benefit in the exemplary embodiments of the present invention which employ a partially or fully overlying or underlying film-like or foil-like security element such as the MOTION™ security device is the increased durability of each watermark. As is well known to those skilled in the art, one of the primary requirements of banknotes and other secure documents is that the document and its security features must resist the effects of circulation. These documents/features must be durable (i.e., resistant to fold damage, tearing and soiling) and resistant to moisture and chemical absorption. Covering all or part of the watermark(s) with an applied film, foil, band, strip, stripe, thread, or patch serves to physically protect the watermark(s) from damage during circulation and handling, thus increasing its durability.

Due to the increased durability afforded these watermarks, it has been determined that these watermarks may be made larger and that the total area within each watermark occupied by reduced fiber density regions (i.e., first regions) may be increased and that these regions may be made even thinner. Specifically, it has been found that these reduced fiber density regions may be produced with thicknesses as low as 10 to 15 microns, with total thicknesses ranging from about 10 to about 60 microns. The total area occupied by these reduced fiber density regions within each such watermark ranges from about 5 to about 75 percent (%) of the total area of the watermark, preferably from about 20 to about 60%. Moreover, the total area occupied by each such watermark within a banknote measuring approximately 10,000 square millimeters ($mm^2$) may range from about 5 to about 25%, which denotes an increase in size compared to conventional watermarks of about 5%.

The present inventors have also made the surprising discovery that micro-optic devices such as the MOTION™ device may also offer a machine detectable/readable feature in the form of enhanced IR-brightness, especially when measured in transmission. The term "enhanced IR-brightness", as used herein, is intended to mean IR-transmission levels of at least 5% greater than (preferably, more than 10% greater than) the IR-transmission levels of the background paper. IR-transmission levels may be measured by using an optical sensor with a sensitivity at or above 830 nanometers (nm) and by projecting an IR light source with a wavelength greater than 800 nm through the sample. To render IR-brightness a reliable machine readable feature, it is preferred that the micro-optic device be made using one or more IR-transparent elements (e.g., an IR-transparent ink) and contain no IR-absorbing elements (e.g., IR-absorbing inks). It is also preferred that no IR-absorbing elements be present in areas close to the device on the front and reverse side of the paper layer(s). In one such embodiment, the micro-optic device is a security thread (e.g., MOTION™ security thread) that contains no IR-absorbing elements. In this embodiment, the micro-optic security thread is made using an IR-transparent ink (e.g., ink comprising non-IR-absorbing pigments and/or dyes) for the microprint and areas on the front and reverse side of the paper layer(s) within at least two-thirds (⅔) of the security thread's length contain no IR-absorbing elements.

In addition to the at least partially overlying or underlying micro-optic device, one or more additional security features may be contained on or within the first and/or second regions of the one or more watermarks. In one such embodiment, the watermark(s) does not contain one or more polymer or resinous materials within the first and/or second regions. The additional security features are selected from the group of increased fiber density areas in the form of recognizable or discernible indicia, one or more substances that are color-imparting, and one or more second level security features that are machine detectable or machine readable, as described above.

In a second exemplary embodiment, the inventive security paper is a multi-ply paper that comprises:

- a first paper layer having a reduced basis weight (e.g., from about 10 to about 50 grams per square meter (gsm)) and including one or more watermarks, each surface of the first paper layer displaying either the upper or face portion of the one or more watermarks or the lower or back portion thereof; and
- a second paper layer having a reduced basis weight (e.g., from about 10 to about 50 gsm) and optionally one or more through windows, the second paper layer covering either the surface of the first paper layer displaying the upper or face portion of the one or more watermarks or the surface displaying the lower or back portion of the one or more watermarks.

In one such embodiment, the second paper layer is windowed, the one or more through windows in the second paper layer being in register with either the upper or face portion or the lower or back portion of the one or more watermarks. By way of this second exemplary embodiment, the use of two paper layers and optionally one or more overlying or underlying through windows allows for a greater contrast between the one or more watermarks and the background. The one or more overlying or underlying through windows act in a manner similar to that of an electrotype, occupying paperless regions or regions of thinner paper which results in brighter-than-background regions in each paper/watermark region.

In a third exemplary embodiment, one or more security elements in the form of one or more color-imparting substances are contained within the first and/or second regions of the one or more watermarks. The one or more color-imparting substances include both dyes and pigments (e.g., ultra-fine particle size pigments). In this embodiment, the security sheet or document does not include one or more film-like or foil-like security elements. The resulting watermarks have a tonality (i.e., color scheme or range of tones) in a color or shade different from that of the bulk region of the material which surrounds the watermark. The inventive watermarks serve to increase the perception and resistance to simulation of existing watermarks.

In a fourth exemplary embodiment, one or more polymer or resinous materials are contained within the first region(s) and optionally the second region(s) of the one or more watermarks. As above, the security sheet or document in this exemplary embodiment does not include one or more film-like or foil-like security elements. The first and/or second regions in this embodiment may also contain one or more security features selected from the group of increased fiber density areas in the form of recognizable or discernible indicia, one or more substances that are color-imparting, and one or more second level security features that are machine detectable or machine readable, as described above.

In a fifth exemplary embodiment, the inventive security sheet or document is a single-ply paper that comprises:

a paper layer including one or more watermarks; and one or more transparent or translucent areas in the paper layer surrounding each of the one or more watermarks, thereby framing and thus enhancing the visual perception of the watermark(s).

Other features and advantages of the invention will be apparent to one of ordinary skill from the following detailed description and accompanying drawings.

Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods/processes, and examples are illustrative only and not intended to be limiting.

BRIEF DESCRIPTION OF THE DRAWINGS

The present disclosure may be better understood with reference to the following drawings. Components in the drawings are not necessarily to scale, emphasis instead being placed upon clearly illustrating the principles of the present disclosure. While exemplary embodiments are disclosed in connection with the drawings, there is no intent to limit the present disclosure to the embodiment or embodiments disclosed herein. On the contrary, the intent is to cover all alternatives, modifications and equivalents.

Particular features of the disclosed invention are illustrated by reference to the accompanying drawings in which:

FIG. 2*a* is another image of the FIG. 1 watermark with overlying security patch that is again viewed in daylight (visible spectrum-reflected light) and under IR-transmitted light from the face side of the security paper, the image enlarged but to a lesser degree than FIG. 1, while

FIG. 3*a* is another image of the FIG. 1 watermark with overlying security patch that is viewed in daylight (visible spectrum-reflected light) from the face side of the security paper, the image enlarged but to a lesser degree than FIG. 1, while

DETAILED DESCRIPTION OF THE INVENTION

Figure 1:
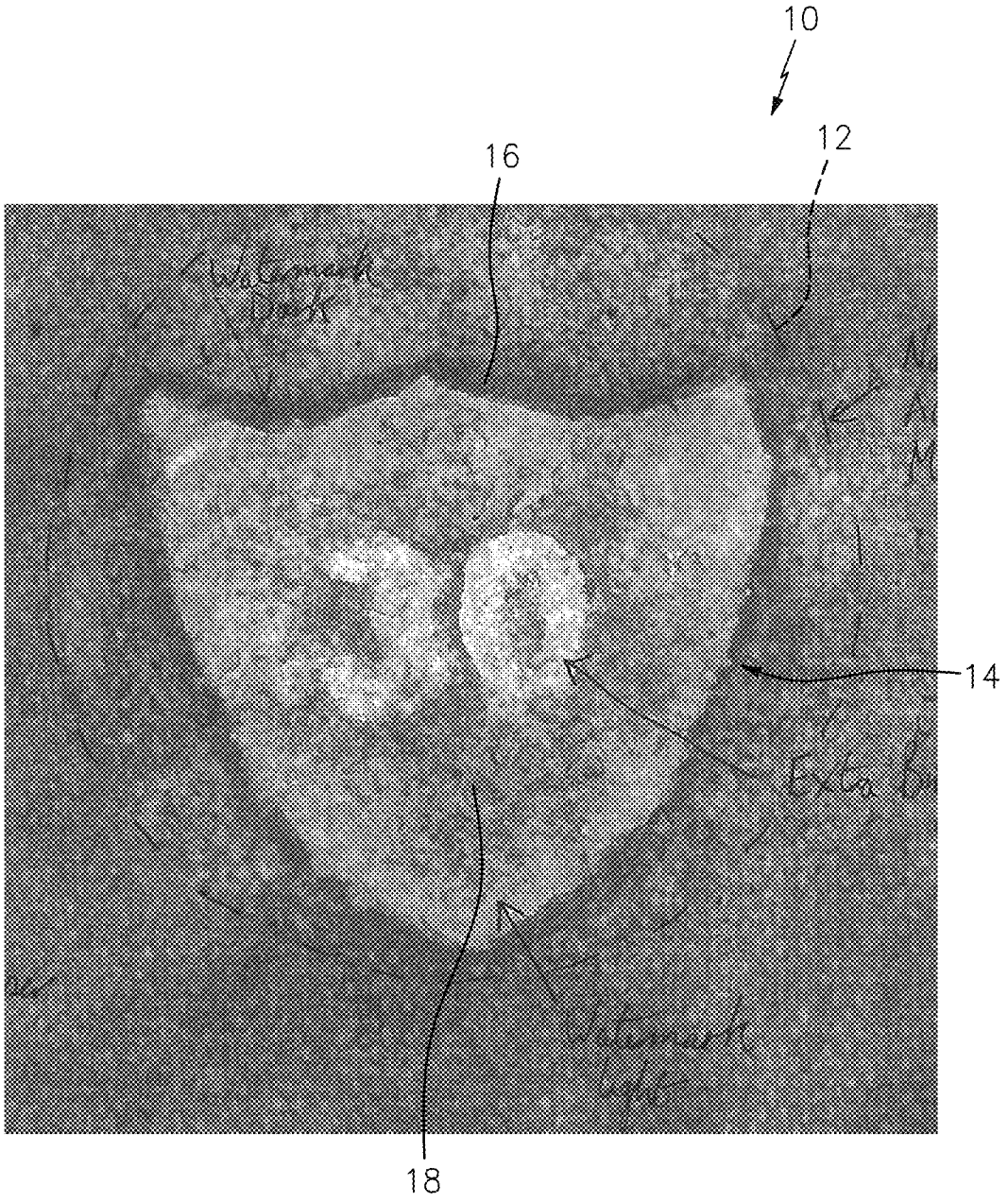
FIG. 1 is an image of a watermark (shield with numeral 30) with overlying MOTION™ security patch on or within an exemplary security paper viewed in daylight (visible spectrum-reflected light) and under IR-transmitted light from the face or front side of the security paper, with the watermark and patch shown at an enlarged scale for clarity.

By way of the present invention, watermarks formed on or within a security sheet or document are enhanced, rendering the security sheet or document more counterfeit-resistant.

The inventive sheet or document, as noted above, comprises: a fibrous sheet material including one or more watermarks; and means for enhancing the one or more watermarks by rendering them visually enhanced, machine detectable/readable, or both.

Fibrous sheet materials suitable for use in the present invention are paper or paper-like sheet materials. These sheet materials, which are single or multi-ply sheet materials, may be made from a range of fiber types including synthetic or natural fibers or a mixture of both. For example, these sheet materials may be made from fibers such as abaca, cotton, linen, wood pulp, and blends thereof. As is well known to those skilled in the art, cotton and cotton/linen or cotton/synthetic fiber blends are preferred for banknotes, while wood pulp is commonly used in non-banknote security documents.

The watermarks may be formed in the fibrous sheet material using known methods and techniques. For example, the watermarked sheet material may be manufactured on a cylinder mold papermaking machine (using an embossed wire cloth, or by applying a thin piece of metal, generally in the form of an image or letter, to the wire cloth), or on a Fourdrinier papermaking machine (using a dandy roll).

Exemplary embodiments of the inventive security sheet or document in which various means for enhancing the watermark(s) are employed, and their respective methods of manufacture will now be discussed.

In a first exemplary embodiment, the inventive security sheet or document is a single- or multi-ply paper that comprises (a) a first paper layer including one or more watermarks, each surface of the paper layer displaying either the upper or face portion of the watermark(s) or the lower or back portion thereof, (b) one or more film-like or foil-like security elements having a color different from the watermark(s) that at least partially covers the upper or face portion or the lower or back portion of the watermark(s), and optionally (c) a second paper layer having a reduced basis weight compared to the first paper layer (e.g., from about 10 to about 50 gsm) and optionally one or more through windows, the second paper layer covering either the upper or face portion or the lower or back portion of the watermark(s).

The film-like or foil-like security element(s) used in the practice of the present invention is limited only by its film-like or foil-like structure, with contemplated structures having total thicknesses ranging from about 15 to about 100 microns (preferably, from about 15 to about 50 microns). The film-like or foil-like structures may take any shape including, but not limited to, bands, strips, stripes, threads, or patches. They may display or project information that is humanly perceivable either directly or with the aid of a device and/or embody information that is detectable/readable by machine. The structures may be segmented into regions, with the information being displayed or projected or otherwise contained in some or all of these regions being the same or different.

Suitable film-like or foil-like security elements may employ one or more of the following: demetalized or selectively metalized, magnetic, combined magnetic and metallic, or embossed (e.g., blind embossed) regions or layers, color changing coatings made up of color shift, iridescent, liquid crystal, photochromic and/or thermochromic materials, coatings of luminescent and/or magnetic materials, holographic and/or diffractive security features, and micro-optic security features.

In a preferred embodiment, the security element(s) is a micro-optic structure. As noted above, such structures project one or more synthetically magnified optical images, and generally comprise: (a) a light-transmitting polymeric substrate; (b) an arrangement of micro-sized image icons located on or within the polymeric substrate; and (c) an arrangement of microlenses. The icon and microlens arrangements are configured such that when the arrangement of icons is viewed through the arrangement of microlenses, one or more synthetically magnified optical images are projected. These projected images may show a number of different optical effects. Such structures are described in U.S. Pat. No. 7,333,268 to Steenblik et al., U.S. Pat. No. 7,468,842 to Steenblik et al., U.S. Pat. No. 7,738,175 to Steenblik et al., International Patent Publication Number WO 2005/106601 A2 to Commander et al., and International Patent Publication Number WO 2007/076952 A2 to Kaule et al. In one such embodiment, a micro-optic structure as described in U.S. Pat. No. 7,333,268 to Steenblik et al. is employed (e.g., the MOTION™ micro-optic security device), the structure being formed from a polymeric substrate prepared using one or more essentially colorless polymers selected from the group including, but not limited to, polyester, polyethylene, polyethylene terephthalate, polypropylene, polyvinyl carbonate, polyvinylidene chloride, and combinations thereof.

In a more preferred embodiment, the micro-optic security device is in the form of a surface-applied patch that covers all or part (e.g., one-half) of a watermark, the watermark containing one or more polymer or resinous materials within the first and/or second regions thereof, the one or more polymer or resinous materials having an index of refraction or combined (final) index of refraction substantially similar to that of cellulose. The first and/or second regions of the watermark may also contain one or more features selected from the group of increased fiber density areas in the form of recognizable or discernible indicia, one or more substances that are color-imparting, and one or more second level security features that are machine detectable or machine readable, as described above.

In another more preferred embodiment, the micro-optic security device is in the form of a surface-applied elongate strip or thread, or a partially embedded elongate security strip or thread that is present in window regions of a second paper layer (i.e., windowed thread). The strip or thread in this embodiment covers all or part of the watermark(s).

In yet a more preferred embodiment, the micro-optic security device (e.g., the MOTION™ device) is designed such that when registered with the watermark, synthetic images projected thereby are combined with the watermark design. For example, in the above-referenced embodiments, the synthetic image(s) generated by each patch or thread may coordinate or link in with the watermark design. The synthetic image(s) may also complete the watermark design(s) or locate within the design(s). This may be a one-sided or two-sided feature. In other words, complete information intended to be conveyed to the viewer is not supplied solely by the watermark or synthetic image(s), but requires that both be viewed simultaneously. In one such example, when viewed at the optimal (perpendicular) viewing angle using visible spectrum-transmitted light, the MOTION™ patch projects a synthetic image in the form of a coat of arms that overlays (in register) the watermark design in the form of a shield. When the viewing angle is moved off-axis, the synthetic image and the watermark design are no longer in register with each other, and one would see the watermark design (shield and numeral 30) within the patch and the synthetic image would transition or switch from the coat of arms to, for example, an array of numerals.

An inherent benefit in the exemplary embodiments of the present invention which employ a partially or fully overlying or underlying film-like or foil-like security element such as the MOTION™ micro-optic security device is the increased durability of each watermark. Covering all or part of the watermark(s) with an applied film, foil, band, strip, stripe, thread, or patch serves to physically protect the watermark(s) from damage during circulation and handling, thus increasing its durability.

Due to the increased durability afforded these watermarks, it has been determined that these watermarks may be made larger and that the total area within each watermark occupied by reduced fiber density regions (i.e., first regions) may be increased and that these regions may be made even thinner. Specifically, it has been found that these reduced fiber density regions may be produced with thicknesses as low as 10 to 15 microns, with total thicknesses ranging from about 10 to about 60 microns. The total area occupied by these reduced fiber density regions within each such watermark ranges from about 5 to about 75 percent (%) of the total area of the watermark, preferably from about 20 to about 60%. Moreover, the total area occupied by each such watermark within a banknote measuring approximately 10,000 $mm^2$ may range from about 5 to about 25%, which denotes an increase in size compared to conventional watermarks of about 5%.

The present inventors have also made the surprising discovery that micro-optic devices such as the MOTION™ device may also offer a machine detectable/readable feature in the form of enhanced IR-brightness, especially when measured in transmission. To render IR-brightness a reliable machine readable feature, it is preferred that the micro-optic device be made using one or more IR-transparent elements (e.g., an IR-transparent ink) and contain no IR-absorbing elements (e.g., IR-absorbing inks). It is also preferred that no IR-absorbing elements be present in areas close to the device on the front and reverse side of the paper layer(s).

Referring now to FIG. 1, one such embodiment of the inventive security sheet or document is shown and marked with reference numeral 10). The micro-optic device is a MOTION™ security patch 12 that contains no IR-absorbing elements. The patch 12 is located over a watermark 14 in the shape of a shield in which dark regions formed by more densely deposited fibers than the normal base fiber density (i.e., second regions) 16 occupy the outer perimeter, light regions formed by less densely deposited fibers than the normal base fiber density (i.e., first regions) 18 occupy the area inside the shield design with the region occupied by the numeral 30 formed by even lighter or less dense regions. The watermark 14 with overlying MOTION™ security patch 12 in FIG. 1 is shown in daylight and under IR-transmitted light, with the watermark and patch illustrated at an enlarged scale for clarity.

As will be readily apparent from viewing FIG. 1, the numeral 30 is very bright as a result of the overlying patch. Here, IR-brightness correlates to the strength of the IR-signal, which as noted above is measured in transmission by using an optical sensor with a sensitivity at or above 830 nm and by projecting an IR light source with a wavelength of greater than 800 nm through the sample. IR-brightness may be controlled by the IR-properties of the ink used for the microprint of the security patch 12. The microprint in the form of micro-sized image icons located on or within a polymeric substrate is made using a printing method (e.g., ink jet, laserjet, letterpress, flexo, gravure, intaglio, and dye sublimation printing methods), or using a microstructure approach. In the latter case, the image icons would be made as voids or recesses in the substrate (e.g., recesses measuring, for example, from about 0.5 to about 8 microns in total depth), or as raised structures relative to the substrate (e.g., raised structures (colored or colorless) measuring, for example, from about 0.5 to about 8 microns in total height). An IR-transparent material (e.g., ink comprising non-IR-absorbing pigments and/or dyes) would be used to form the icons by, for example, printing, coating or partially or completely filling the recesses or areas surrounding the raised structures, or forming raised (colored or colorless) structures. It is preferred that areas on the front and reverse side of the paper layer(s) within a distance of approximately 5 millimeters from an outer edge of the patch would contain no IR-absorbing elements.

In regard to the appearance of the FIG. 1 embodiment, and as shown in FIGS. 2*a-d* and 3*a-d:*

Figure 2A:
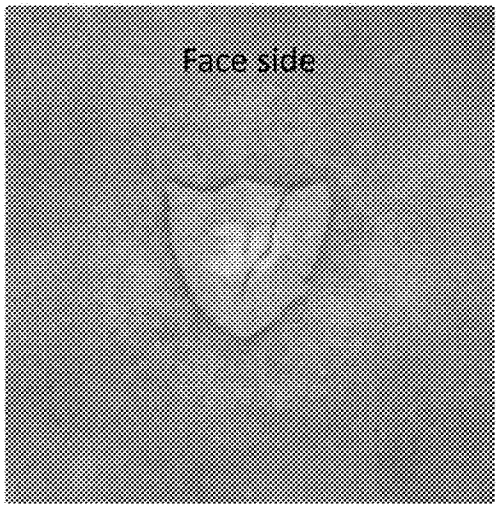
Figure 2B:
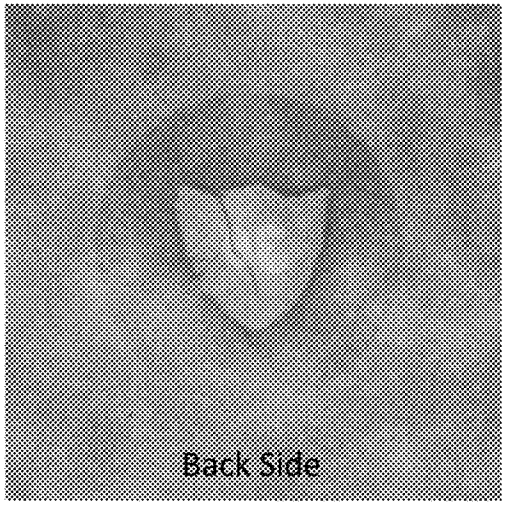
FIGS. 2*b-d* are enlarged images of the same watermark with overlying security patch shown—in IR-transmitted light from the back side of the security paper (FIG. 2*b*), in IR-reflected light from the face side of the security paper (FIG. 2*c*), and in IR-reflected light from the back side of the security paper (FIG. 2*d*)
Figure 2C:
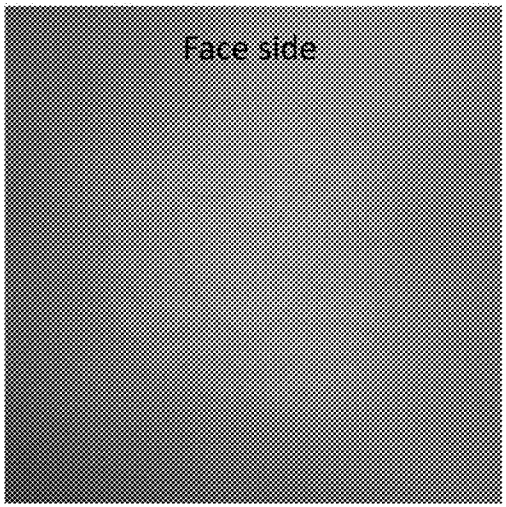
Figure 2D:
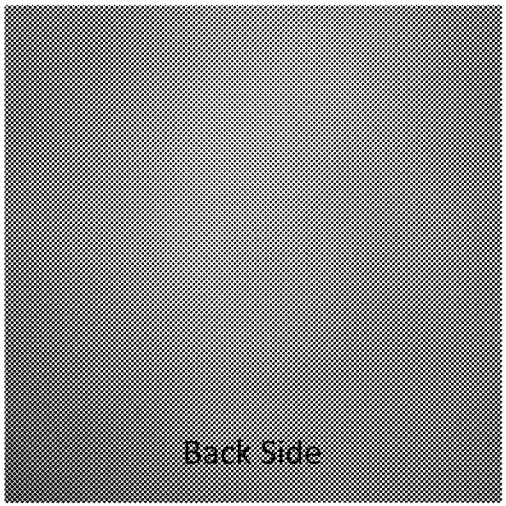
Figure 3A:
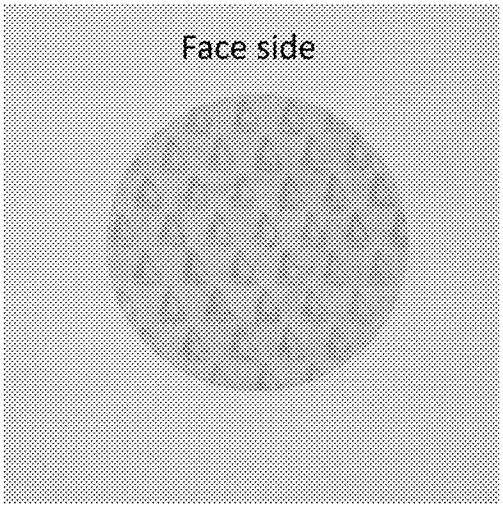
Figure 3B:
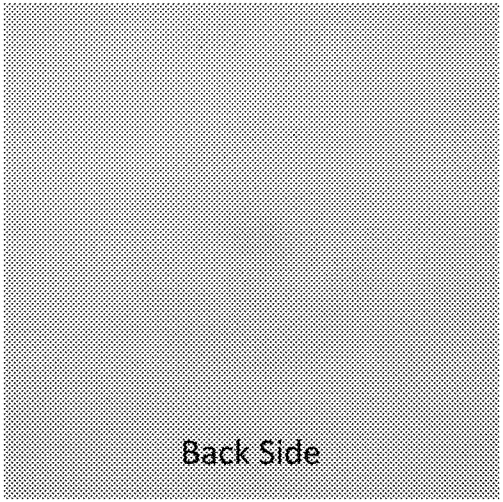
FIGS. 3*b-d* are enlarged images of the same watermark with overlying security patch shown—in visible spectrum-reflected light from the back side of the security paper (FIG. 3*b*), in visible spectrum-transmitted light from the face side of the security paper (FIG. 3*c*), and in visible spectrum-transmitted light from the back side of the security paper (FIG. 3*d*)
Figure 3C:
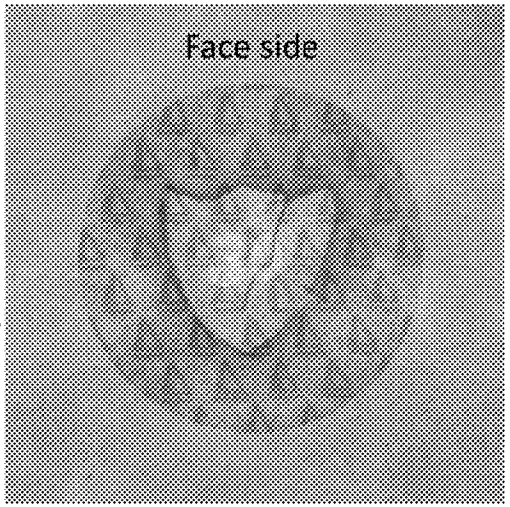
Figure 3D:
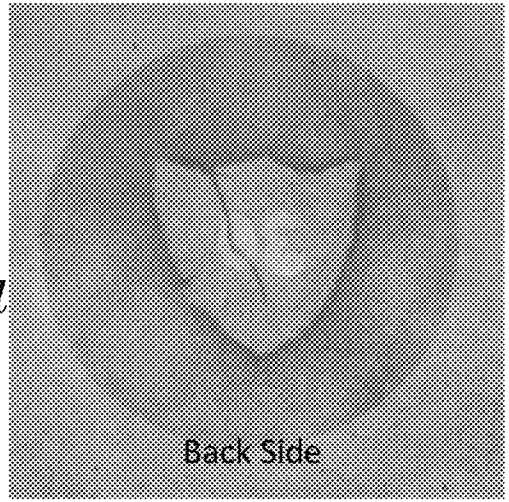

(a) In IR-transmission or IR-transmitted light from the front or face of the document, one would see the watermark (shield and the numeral 30) and a faint patch overlay (see FIG. 2*a*);

(b) In IR-transmission from the back of the document, one would see the watermark (shield and the numeral 30) in reverse and a darker patch overlay (see FIG. 2*b*);

(c) In IR-reflected light from the face of the document, one would see the watermark (outline only) and a faint patch overlay (see FIG. 2*c*);

(d) In IR-reflected light from the back of the document, one would not see either the watermark or the patch overlay (see FIG. 2*d*);

(e) In visible spectrum-reflected light, from the face of the document, one would see the one or more synthetic images but not the watermark (or only a faint outline of the watermark) (see FIG. 3*a*);

(f) In visible spectrum-reflected light, from the back of the document, one would see the watermark as dark (see FIG. 3*b*);

(g) In visible spectrum-transmitted light, from the face of the document, one would see the combined image of the watermark and the one or more synthetic images (see FIG. 3*c*); and (h) In visible spectrum-transmitted light, from the back of the document, one would see the watermark (shield and the numeral 30) in reverse with a colored overlay of the patch, but not the projected synthetic image(s) (see FIG. 3*d*).

As mentioned above, in addition to the at least partially overlying or underlying micro-optic device, one or more additional security features may be contained on or within the first and/or second regions of the one or more watermarks. In one such embodiment, the watermark(s) does not contain one or more polymer or resinous materials within the first and/or second regions. The additional security features are selected from the group of increased fiber density areas in the form of recognizable or discernible indicia, one or more substances that are color-imparting, and one or more second level security features that are machine detectable or machine readable, as described above.

Reference is now made to methods or techniques for making the first exemplary embodiment in which a fibrous sheet material with a film-like or foil-like security element is registered in the machine direction (MD) with respect to one or more watermarks contained or formed in the sheet material.

The film-like or foil-like security elements may be embedded (when in the form of, for example, a security strip or thread) in a second paper layer, or applied to a surface of the watermarked paper layer or second paper layer (when in the form of, for example, a thread or patch) using known methods and techniques. For example, the security element(s) (with one or more adhesive layers) may be transferred to a surface of the watermarked or second paper layer as a transfer film using techniques including mechanical, chemical, thermal and photo-induced separation techniques. The concept of separation of desired components from a carrier substrate is known in the art of holographic foil transfer, whereby a film with a release coating (i.e., release liner) is provided with coatings (e.g., optical) and adhesives, such that the coatings and adhesives can be transferred to a final substrate with application of heat and pressure. This approach is particularly useful in applications requiring films with very thin cross-sectional thicknesses.

Activatable adhesives may be used to anchor or bond the film-like or foil-like security elements onto or within a surface of the fibrous sheet material. Suitable adhesives are not limited and include, but are not limited to, water-, heat- and/or pressure-activating adhesives that activate in the secondary dryer section of the papermaking machine, where temperatures reach between 100° C. and 160° C. These coatings may be applied in the form of solvent-based polymer solutions or aqueous solutions or dispersions. Suitable dispersions are selected from the group of acrylic resin dispersions, epoxy resin dispersions, natural latex dispersions, polyurethane resin dispersions, polyvinyl acetate resin dispersions, polyvinyl alcohol resin dispersions, urea formaldehyde resin dispersions, vinyl acetate resin dispersions, ethylene vinyl acetate resin dispersions, ethylene vinyl alcohol resin dispersions, polyester resin dispersions, and mixtures thereof.

Machine direction registration of security patches to watermarks contained on or formed in the sheet material may be achieved by indexing the relative position of the watermark(s) on the equipment used to produce the watermark(s) in the paper sheet. The watermark(s) position is then conveyed in a continuous manner to the equipment used to apply the security patch(es) to the paper surface. Pre-applied marks or indexes on the carrier film used to convey the patch(es) is used to control the speed of the carrier film and thus the patch(es), thereby ensuring registration of the watermark(s) with the patch(es).

Machine direction registration of a security thread to watermarks contained on or formed in the sheet material will now be described in conjunction with FIGS. 4 to 6.

Figure 4:
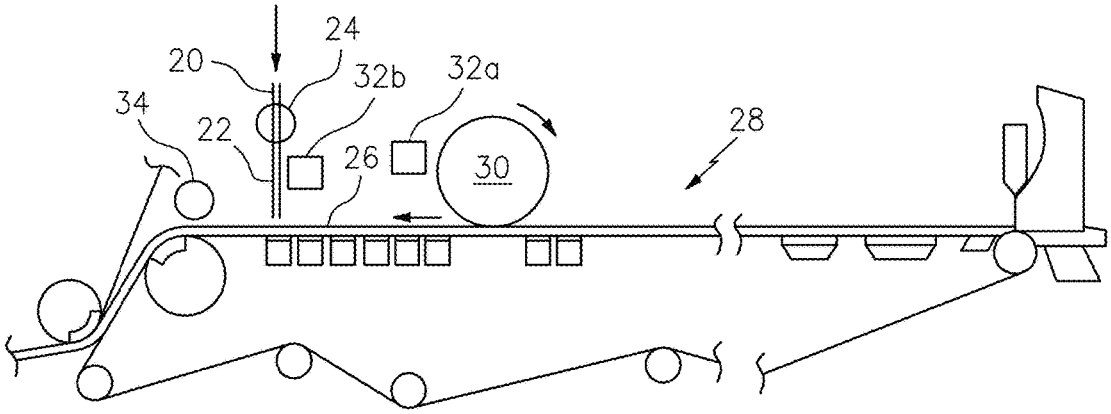
FIG. 4 is a schematic diagram of a modified Fourdrinier or twin-wire papermaking machine by which watermarks are incorporated along the machine direction of a forming paper web via a dandy roll cylinder, and by which a security element in the form of an elongate security thread is applied to a surface of the watermarked paper web before the wet press section of the machine. The machine employs means for machine direction registration of the watermarks and the elongate security thread to the paper web. This method for making the inventive sheet material does not displace fiber distribution, resulting in a higher fiber distribution with increased substrate density and stiffness which resists deformation, distortion and creasing of the security thread.

In FIG. 4, a Fourdrinier process for making a single-ply embodiment of the fibrous sheet material of the present invention is shown. In this process, an adhesive coated security thread 20 (oriented such that the front side of the security thread and not the adhesive coated back side is an uppermost layer) is guided along a tube 22 with a variable speed advancing device 24 (e.g., electric servomechanism with servo drive) and pushed into a surface of a partially consolidated advancing fibrous web 26 (e.g., a fibrous slurry containing from about 1 to about 10% by weight stock and from about 99 to about 90% by weight water) at the wet end 28 of the paper-making machine after the web 26 has been watermarked by a dandy roll cylinder 30. Here, the security thread 20 may be positioned either partially or completely on top of the watermark(s) (i.e., layered security features) on the surface of the web 26. As will be readily appreciated by those skilled in the art, the dandy roll cylinder 30 may be provided with raised and/or recessed areas on its surface, which may fully or partially overlap the area on the surface of the web 26 that will be occupied by the thread 20.

It is noted that this embodiment of the inventive method does not serve to disrupt fiber distribution around the surface applied security thread, resulting in a higher density fiber distribution with increased substrate density and stiffness which resists security thread deformation, distortion and creasing.

As water continues to drain from web 26, the fibers form around the thread 20 holding it in place on a front or upper surface of web 26. Upon leaving the wet end 28, the fibrous web 26 is passed through the press, main and secondary dryer and calender sections of the paper-making machine. While in the secondary dryer section of the paper-making machine, the web 26 is exposed to temperatures and/or pressures sufficient to activate the security thread's adhesive coating, causing it to firmly bond the thread in the fibrous sheet material, with the security thread continuously exposed on a front or upper surface of the sheet material partially or fully covering the formed watermark(s), while concealed from view on a back or lower surface of the sheet material.

Machine directional registration of the security thread 20 to the formed watermark(s) is achieved using conventional techniques commonly used in the art. For example, and as best shown in FIG. 4, an automatic registration control system for a papermaking machine is used, which includes the variable speed security thread advancing device 24, optical sensors 32*a*, 32*b* for tracking registration marks on the dandy roll cylinder 30 and on the security thread 20, and an encoder wheel 34 for tracking the speed of the paper being formed on the machine.

As the forming web 26 moves through the wet end 28 of the papermaking machine, registration marks placed on the dandy roll cylinder 30 and on the security thread 20 are continuously tracked by the optical sensors 32*a*, 32*b*, thereby continuously determining/monitoring the position of the security thread 20 being fed through the tube 22 and advancing device 24 and the position of the watermark(s) relative to an edge of the forming web 26, while the speed of the paper being formed is tracked by the encoder wheel 34. Signals are produced from the position and speed determinations and the speed and position of the advancing device 24 adjusted on the basis of those signals in such a way that the security thread 20 and the watermark(s) are registered along the machine direction of the web 26.

Figure 5:
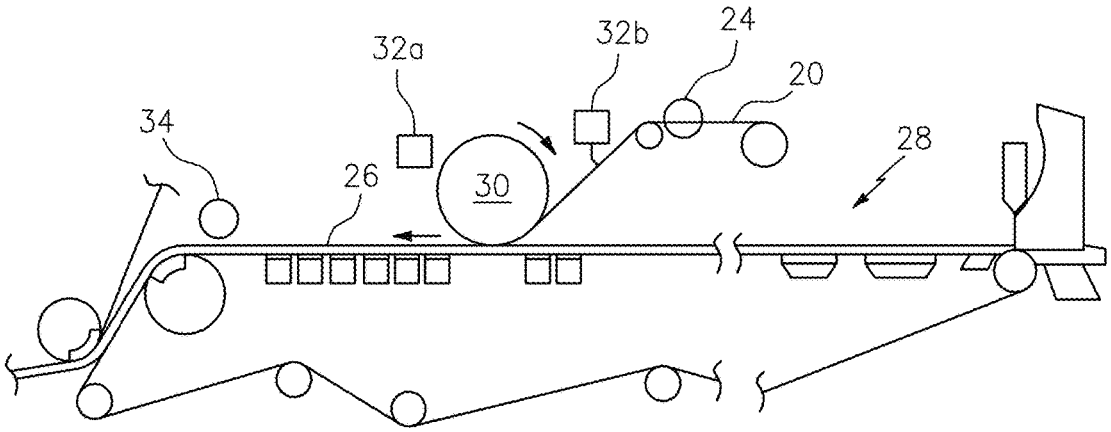
FIG. 5 is a schematic diagram of another modified Fourdrinier or twin-wire papermaking machine by which an elongate security thread is fed onto a surface of the fibrous web at the same time or right before the watermark(s) is incorporated therein and before the wet press section of the machine. The machine employs means for machine direction registration of the elongate security thread and the watermark(s) to the fibrous web. This method for making the fibrous sheet material of the present invention results in fiber flowing around the thread, resulting in a lower density fiber distribution with reduced density and stiffness under the surface applied thread.

In another embodiment of the inventive method, which is shown in FIG. 5, the adhesive coated security thread 20 (again oriented such that the security thread and not the adhesive coating is an uppermost layer) is guided through the variable speed advancing device 24 and past optical sensor 32*b* and then pushed into a surface of the partially consolidated forming fibrous web 26 by the dandy roll 30 at the wet end 28 of the paper-making machine, the dandy roll 30 simultaneously or subsequently watermarking the web 26. It is noted that by way of this embodiment of the inventive method, fiber flows around the security thread, resulting in a lower density fiber distribution with reduced substrate density and stiffness under the thread.

Similar to that noted above, as the forming web 26 moves through the wet end 28 of the papermaking machine, registration marks placed on the dandy roll cylinder 30 and on the security thread 20 are continuously tracked by the optical sensors 32*a*, 32*b*, thereby continuously determining/monitoring the position of the watermark(s) and the position of the security thread 20 being applied to a surface of the web 26 relative to an edge of the forming web 26, while the speed of the paper being formed is tracked by the encoder wheel 34. Signals are produced from the position and speed determinations and the speed and position of the advancing device 24 adjusted on the basis of those signals in such a way that the security thread 20 and the watermark(s) are registered along the machine direction of the web 26.

Figure 6:
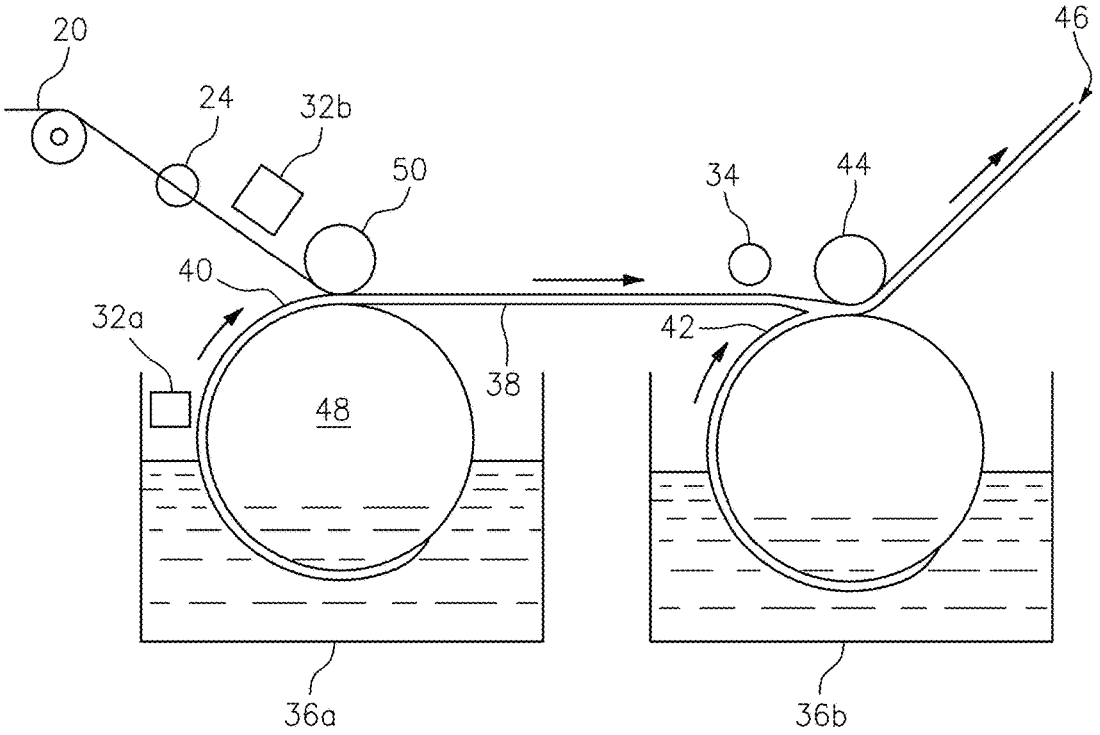
FIG. 6 is a schematic diagram of a paper-making machine made up of two cylinder paper machines interconnected by a pick-up felt, where an elongate security thread contacts a watermarked paper web formed by one cylinder paper machine before joining a second paper web formed by the other cylinder paper machine. This machine also employs means for machine direction registration of the elongate security thread and the watermark(s) to the first paper web.

A cylinder mold process for making a two-ply embodiment of the fibrous sheet material of the present invention is shown in FIG. 6. In this process, which employs two cylinder paper machines 36*a*, 36*b*, interconnected by pick-up felt 38, two paper webs 40, 42, are formed simultaneously, squeezed together in the area of roller 44, and then fed together to the press, dryer and calender sections of the paper-making machine. The resulting fibrous sheet material has the same physical characteristics as those noted above for sheet materials made using a Fourdrinier process. As will be readily appreciated by those skilled in the art, while FIG. 6 shows cylinder paper machines of the wet vat type, cylinder paper machines of the dry vat type may also be used to make the fibrous sheet material of the present invention.

The two-ply paper web 46, formed by the cylinder paper machines shown in FIG. 6, has adhesive coated security thread 20 recessed and one or more watermarks formed in a surface thereof, with the security thread 20 and the watermark(s) fully viewable from this surface. The watermark(s) is formed in paper web 40 by forming cylinder 48 and then the security thread 20 is integrated into the paper web by directing the thread through the variable speed advancing device 24 and past optical sensor 32*b* and then between roller 50 and a surface of the paper web exiting cylinder paper machine 36*a*. Here, the security thread 20 may be positioned partially or completely on top of the watermark(s) on the surface of the paper web. Paper web 40 with surface applied security thread 20 and watermark(s) is then directed between roller 44 and a surface of the second paper web 42 exiting cylinder paper machine 36*b*, where the two paper webs are squeezed together. The second paper web 42 is homogeneous and serves to hide any irregularities in paper formation on a back or lower surface of the first paper web 40 that may have been caused by the presence of thread 20.

As alluded to above, forming cylinder 48 may be provided with raised and/or recessed areas on its surface, which may fully or partially overlap the area contacted by thread 20 during manufacture.

As in previous embodiments, machine directional registration between the security thread 20, the watermark(s) and the paper web 40 is achieved by the variable speed security thread advancing device 24, optical sensors 32*a*, 32*b* for tracking registration marks on the forming cylinder 48 and on the security thread 20, and an encoder wheel 34 for tracking the speed of the paper being formed on cylinder paper machine 36*a*.

Upon exiting the calender section of any of the above-referenced paper-making machines, the inventive fibrous sheet material may be wound up and stored or directly introduced into another machine (e.g., a printing machine) for further processing.

In a second exemplary embodiment, the inventive security paper is a multi-ply paper that comprises:

- a first paper layer having a reduced basis weight (e.g., from about 10 to about 50 gsm) and including one or more watermarks, each surface of the first paper layer displaying either the upper or face portion of the one or more watermarks or the lower or back portion thereof; and
- a second paper layer having a reduced basis weight (e.g., from about 10 to about 50 gsm) and optionally one or more through windows, the second paper layer covering either the surface of the first paper layer displaying the upper or face portion of the one or more watermarks or the surface displaying the lower or back portion of the one or more watermarks.

In one such embodiment, the second paper layer is windowed, the one or more through windows in the second paper layer being in register with the one or more watermarks. By way of this second exemplary embodiment, the use of two paper layers and optionally one or more overlying through windows allows for a greater contrast between the one or more watermarks and the background.

In a third exemplary embodiment, one or more security elements in the form of one or more color-imparting substances are contained within the first and/or second regions of the one or more watermarks. The one or more color-imparting substances include both dyes and pigments (e.g., ultra-fine particle size pigments). As noted above, in this embodiment, the security sheet or document does not include one or more film-like or foil-like security elements. The resulting watermarks have a tonality (i.e., color scheme or range of tones) in a color or shade different from that of the bulk region of the material which surrounds the watermarks, which serves to increase their perception and resistance to simulation.

Watermarks have traditionally been the same color as the paper substrate on or within which they are carried. These marks are formed by localized variation in the thickness of the paper that changes the opacity of the paper, making the watermark visible in transmitted light or in reflected light atop a dark background.

Figure 7:
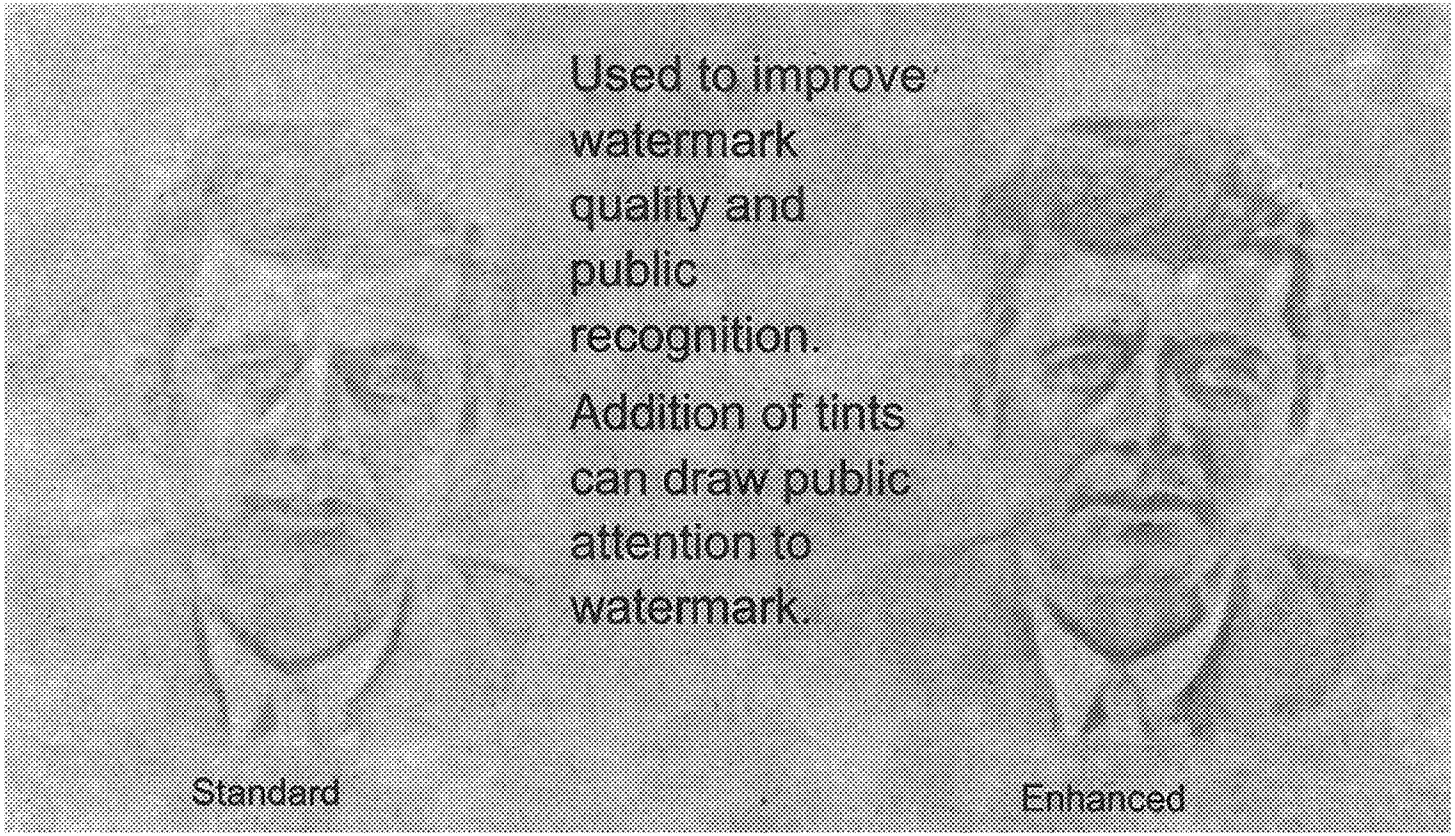
FIG. 7 provides in a side-by-side comparison enlarged images of a prior art watermark and an exemplary embodiment of the inventive enhanced watermark, which has a strikingly bright or intense appearance.

A prior art or standard watermark is shown against the same color paper substrate in FIG. 7. Here, only a marginal contrast between light and dark areas in the watermark is evident rendering the watermark more difficult to detect. By way of comparison, as also shown in FIG. 7, the enhanced watermark of the present invention, which includes one or more color-imparting substances in the form of one or more visible (colored) pigments (i.e., blue), has improved quality in which the contrast between the light and dark areas in the watermark is significantly greater. The public's attention is therefore drawn more readily to the inventive watermark increasing the effectiveness of this security feature.

Figure 8:
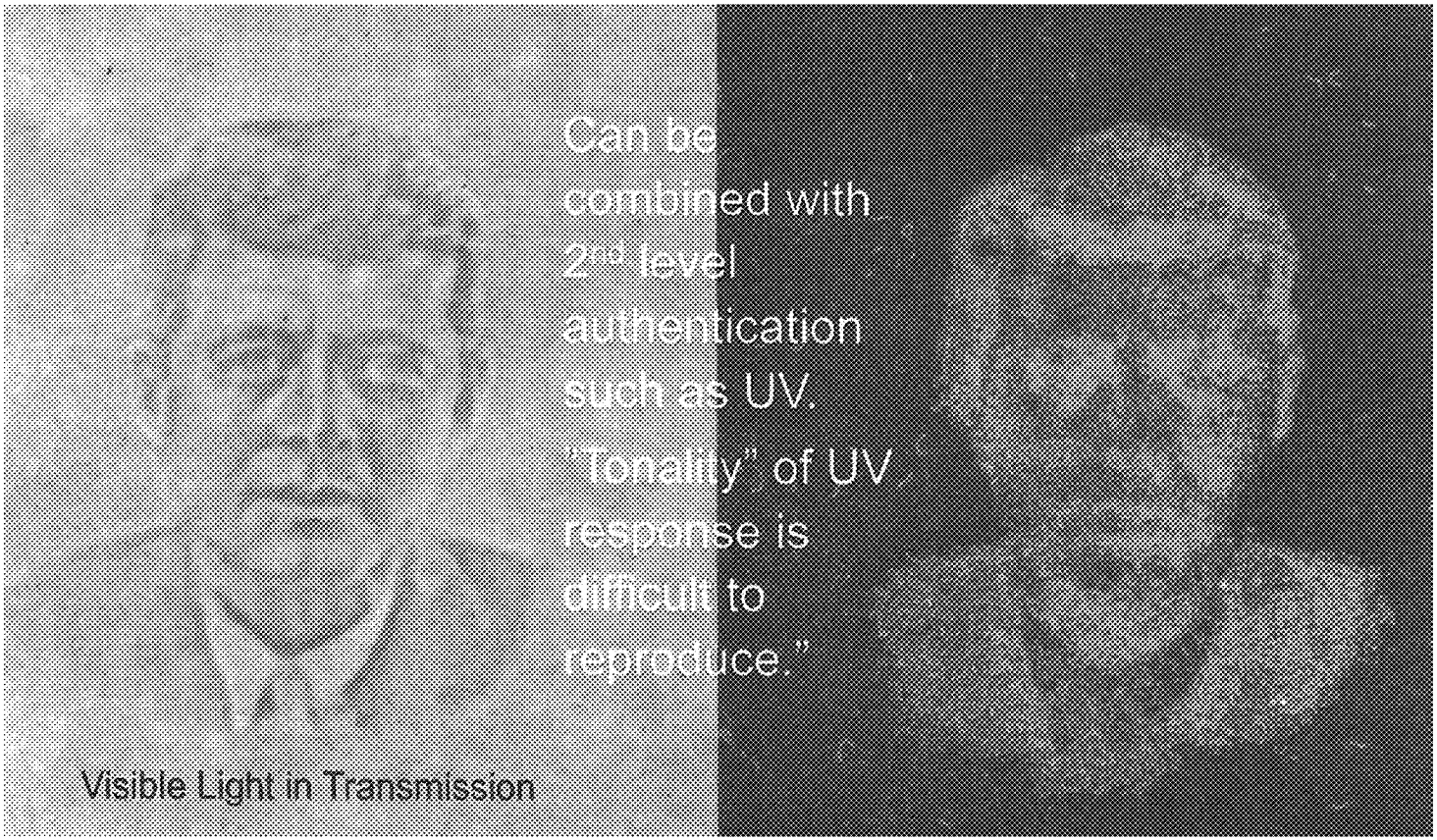
FIG. 8 provides in a side-by-side comparison enlarged images of an exemplary embodiment of the inventive watermark which employs a UV excitable second level security feature in both transmitted light and under UV light.

Another exemplary embodiment of the present invention is shown in FIG. 8. Here, the inventive watermark contains a second level security feature in the form of a UV excitable substance in addition to one or more color-imparting substances. The inventive watermark not only demonstrates a marked contrast between light and dark areas in transmitted light, but because it also contains a substance which can be excited by UV radiation, it also demonstrates a tonality of UV response that is difficult to reproduce, thereby rendering this watermark embodiment even more counterfeit resistant.

Figure 9A:
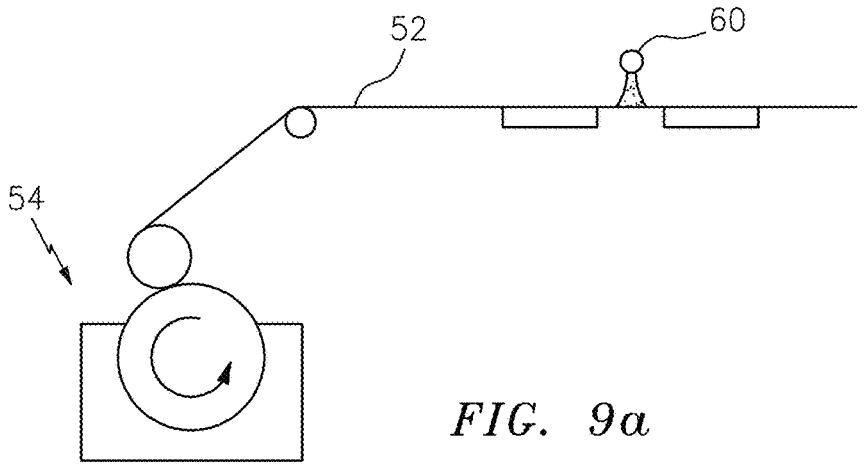
FIGS. 9*a,b* are schematic drawings depicting a method for manufacturing an exemplary embodiment of the paper security document of the present invention.
Figure 9B:
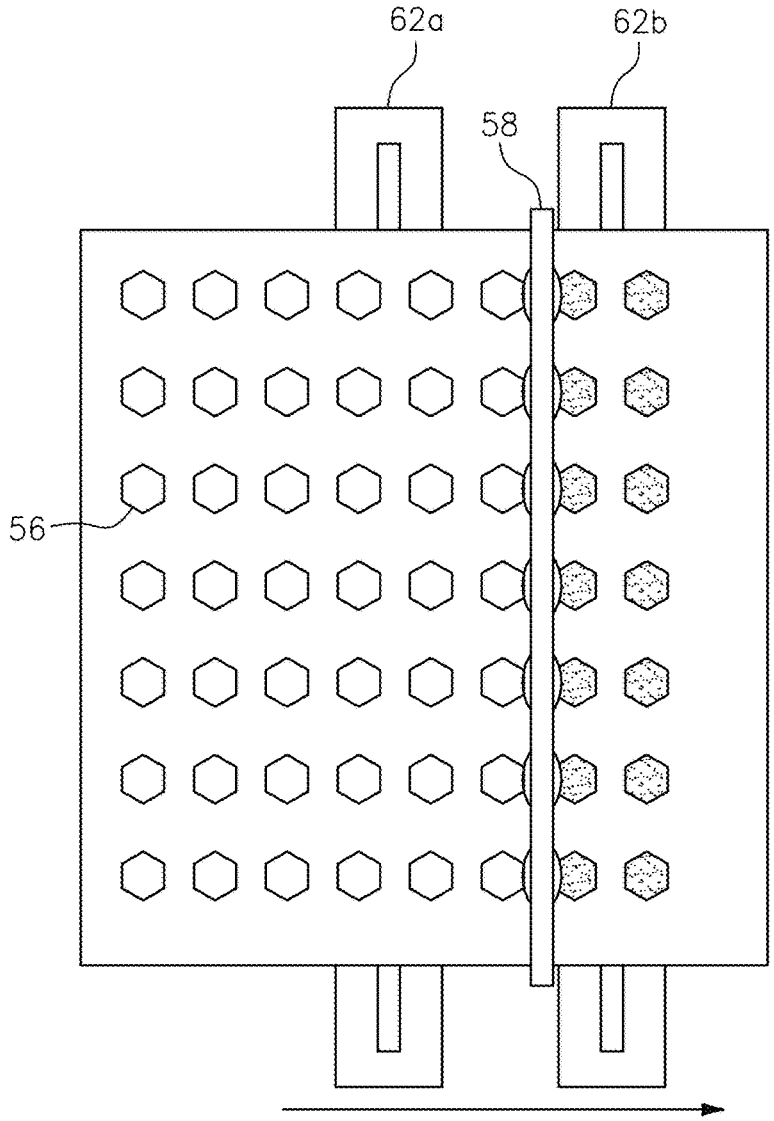

Referring now to FIG. 9, in an exemplary embodiment in which the security sheet or document is a paper security document, the inventive method for manufacturing the security document involves making a continuous roll of watermarked paper 52 on a paper making machine 54 (FIG. 9*a*), watermarks or watermark regions 56 repeating along the length of the paper (FIG. 9*b*), each having lower grammage areas (i.e., first regions) and higher grammage areas (i.e., second regions), so as to provide lighter and darker areas in the watermark regions 56, the method comprising:

applying a colored solution 58 comprising color-imparting substances to the plurality of watermark regions 56 on one side of the continuous roll of paper while applying a vacuum to an opposing side of the paper to pull the applied colored solution into the paper, wherein, higher grammage areas of the watermark regions 56 hold more color-imparting substances while lower grammage areas hold less color-imparting substances, thereby providing the watermark regions tonality in a color or shade different from that of bulk regions of the paper surrounding the plurality of watermark regions repeating along its length.

As previously noted, the watermarks are formed by well-known techniques on, for example, a cylinder mold papermaking machine or a Fourdrinier papermaking machine (using a dandy roll). A range of fiber types can be used in making the paper, including synthetic or natural fibers or a mixture of both.

The "colored solution" used to impart tonality to the watermarks of the present invention comprises the one or more color-imparting substances referred to above, which include both dyes and pigments (e.g., ultra-fine particle size pigments).

After forming watermarks on the paper machine 54, the colored solution 58 is applied locally to the watermark regions 56 of the paper while the paper is still wet and on a forming wire and before any wet pressing occurs. The colored solution may be applied to the continuous roll of watermarked paper 52 using a low volume intermittent shower with nozzles 60 aligned to the watermark regions of the paper. The colored solution is drawn into the paper web using one or more vacuum boxes 62. Although two vacuum boxes are shown in FIG. 9*b*, one or more vacuum boxes may be used in the practice of the inventive method.

In a fourth exemplary embodiment, which will be referred to as the 'see-through' watermark embodiment, one or more polymer or resinous materials are contained within the first region(s) and optionally the second region(s) of the one or more watermarks. As noted above, the security sheet or document in this exemplary embodiment does not include one or more film-like or foil-like security elements. The first and/or second regions in this embodiment may also contain one or more security features selected from the group of increased fiber density areas in the form of recognizable or discernible indicia, one or more substances that are color-imparting, and one or more second level security features that are machine detectable or machine readable, as described above.

The see-through watermark embodiment of the present invention provides an easily recognized public security feature for first-level authentication. The inventive watermark(s), which may be a paper-borne feature, allows for authentication by its transmissive properties. The inclusion of such a translucent or transparent region within a security document (e.g., banknote) cannot be replicated with scanning, image analysis, and subsequent digital reproduction techniques.

In an exemplary embodiment, the inventive see-through watermark(s) is obtained as part of the papermaking process during sheet formation in the wet state. For example, a paper web is made in a continuous manner on a Fourdrinier papermaking machine. Paper stock is deposited from a head box onto a continuous moving wire mesh. Water from the paper stock then drains through the wire mesh leaving a wet de-watered fiber mat.

Figure 10:
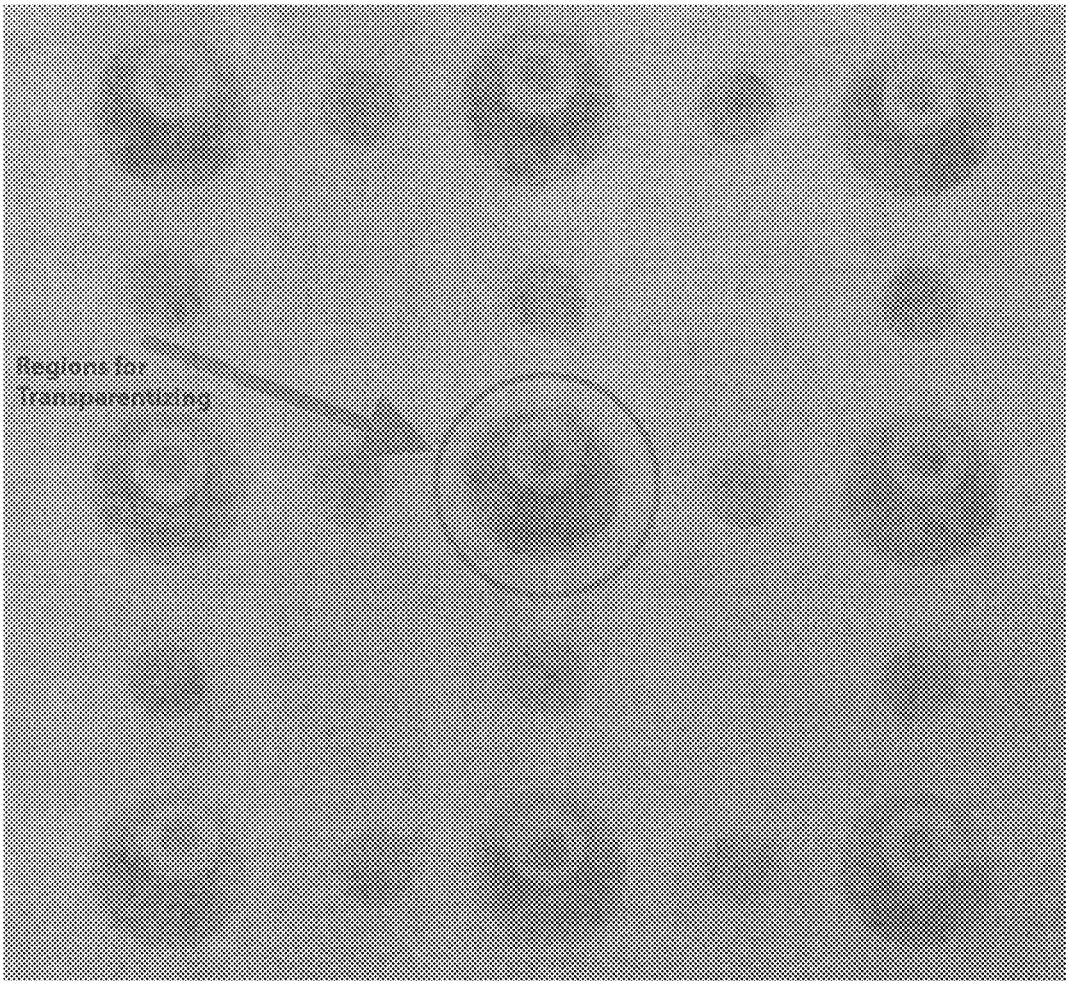
FIG. 10 is an enlarged image of a fiber mat or sheet in the wet state on a papermaking machine (viewed in reflected light on a dark background) with paper stock removed in select areas of the sheet with a resultant reduction in fiber density in those select areas. The select areas are circular in shape and are shown in two different sizes, with the larger sized select areas also containing a circular region of greater fiber density.

The inventive see-through watermark(s) is formed by first removing paper stock from select areas of the fiber mat with a resultant reduction in fiber density (see FIG. 10). This may be done using conventional techniques such dandy roll (or cylinder vat) technology. The select areas with lower fiber density (i.e., the first regions) have reduced opacity relative to other areas of the watermark(s) (i.e., the second regions) and other areas of the fiber mat (i.e., the base sheet), though not transparent. Next, the first and optionally the second regions of the watermark(s) are treated with one or more polymer or resinous materials chosen for a final refractive index which closely matches cellulose (e.g., a UV curable, e-beam curable, or thermal curable polymer or resinous material).

The first and second regions may be treated with the one or more polymer or resinous materials on the papermaking machine, in an off-line web process such as rewinding or respooling, in a dedicated off-line web process prior to sheet cutting, or on individual sheets.

The one or more polymer or resinous materials, which saturate the paper in the first and optionally the second regions of the watermark(s) (replacing air in the interstices between fibers), may optionally be applied in a pattern over these areas, and may further be cured via radiation, thermal/catalytic, or oxidative means.

Figure 11A:
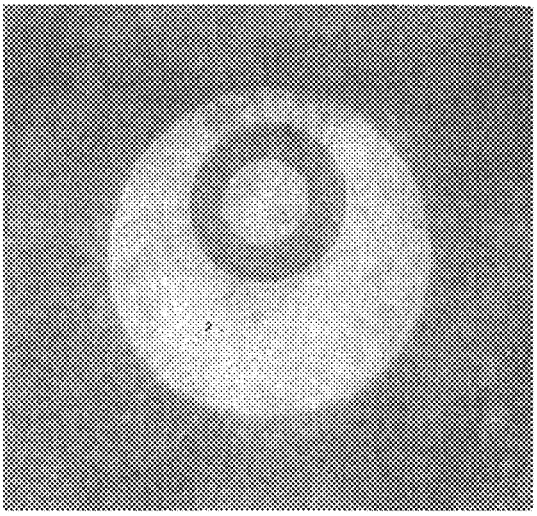
FIG. 11*a,b* are enlarged images of the encircled select area shown in FIG. 10 (viewed in transmitted light) after treatment with one or more polymer or resinous materials having an index of refraction or combined index of refraction substantially similar to that of cellulose. The first enlarged image (FIG. 11*a*) shows the circular region within the select area having a color similar to that of the surrounding fiber mat or sheet, while the second enlarged image (FIG. 11*b*) demonstrates that printed material viewed under this exemplary embodiment of the inventive security element is clearly legible.
Figure 11B:
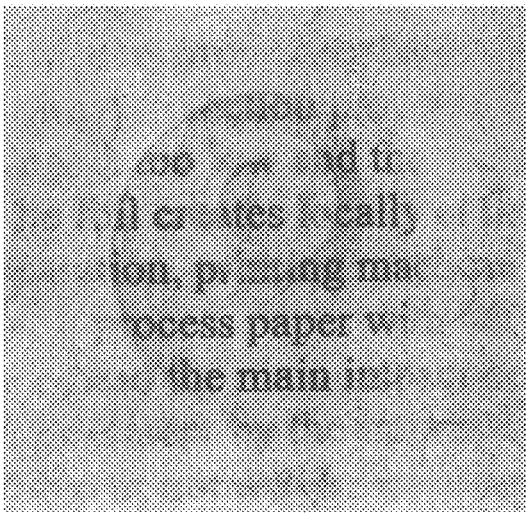

As best shown in FIGS. 11*a,b*, transmission of visible light is now possible through the resulting translucent or transparent see-through watermark(s). As a result, printed material viewed under the see-through watermark(s) is clearly legible.

The choice of a polymer or resinous material(s) of appropriate modulus may also allow for embossing, applications within the translucent or transparent areas to be performed, for example, prior to printing, or during an intaglio printing process.

The inventive see-through watermark(s) may also include one or more features within its perimeter selected from the group of increased fiber density areas in the form of recognizable or discernible indicia, one or more substances that are color-imparting, and one or more second level security features that are machine detectable or machine readable, as described above.

These features in the form of, for example, fibers or planchettes may be added via random addition to the papermaking furnish, or selectively placed in-line in the position of the see-though security element. In addition, or alternatively, such inclusions could be concentrated in specific cross-direction areas of the paper.

In a fifth exemplary embodiment, the inventive security sheet or document is a single-ply paper that comprises:

a paper layer including one or more watermarks; and one or more transparent or translucent areas in the paper layer surrounding each of the one or more watermarks, thereby framing and thus enhancing the visual perception of the watermark(s).

Such frame-like areas may be formed in the watermarked paper layer by treating the areas surrounding each watermark with one or more transparentizing polymer or resinous materials, such as a UV curable, e-beam curable, or thermal curable polymer or resinous material.

These frame-like areas may be treated with the transparentizing material(s) on the papermaking machine, in an off-line web process such as rewinding or respooling, in a dedicated off-line web process prior to sheet cutting, or on individual sheets.

The transparentizing material(s) saturates the paper in the applied areas replacing air in the interstices between fibers. This material(s) may be curable or non-curable. Treated areas of the watermarked paper layer allow for the transmission of visible light, thereby framing and thus enhancing the visual perception of watermark(s).

While various embodiments of the present invention have been described above it should be understood that they have been presented by way of example only, and not limitation. Thus, the breadth and scope of the present invention should not be limited by any of the exemplary embodiments.

The invention claimed is:

1. A security sheet or document having one or more enhanced watermarks or watermark designs, which comprises:

a fibrous sheet material including one or more watermarks or watermark designs, wherein each watermark design has one or more first regions with reduced fiber densities relative to surrounding regions of the fibrous sheet material and one or more second regions with similar or increased fiber densities relative to surrounding regions of the sheet material, and wherein each watermark design has an upper or face portion and a lower or back portion; and one or more transparent or translucent areas comprising one or more transparentizing materials surrounding each of the one or more watermark designs.

2. A security sheet or document having one or more enhanced watermarks or watermark designs, which comprises:

a fibrous sheet material including one or more watermarks or watermark designs, wherein each watermark design has one or more first regions with reduced fiber densities relative to surrounding regions of the fibrous sheet material and one or more second regions with similar or increased fiber densities relative to surrounding regions of the sheet material, and wherein each watermark design has an upper or face portion and a lower or back portion; and the one or more enhanced watermarks or watermark designs are visually enhanced, machine detectable or readable, or both, wherein the one or more enhanced watermarks or watermark designs comprises one or more film-like or foil-like security elements that at least partially cover the face or the back portion of the one or more enhanced watermarks or watermark designs, wherein the one or more film-like or foil-like security elements is in the form of a band, strip, stripe, thread, or patch, wherein the one or more film-like or foil-like security elements is one or more micro-optic film materials that each comprise an arrangement of microlenses and an arrangement of micro-sized image icons, which are configured such that when the arrangement of image icons is viewed through the arrangement of microlenses, one or more synthetically magnified optical images are projected, wherein the one or more micro-optic film materials each display colored images on a transparent or tinted background or each display colored images on a translucent or substantially opaque background of a color different than the color of the colored images, wherein the one or more micro-optic film materials is made using only infrared-transparent materials, wherein the security sheet or document demonstrates enhanced IR-brightness when measured in transmission.

3. A security sheet or document having one or more enhanced watermarks or watermark designs, which comprises:

a fibrous sheet material including one or more watermarks or watermark designs, wherein each watermark design has one or more first regions with reduced fiber densities relative to surrounding regions of the fibrous sheet material and one or more second regions with similar or increased fiber densities relative to surrounding regions of the sheet material, and wherein each watermark design has an upper or face portion and a lower or back portion; and the one or more enhanced watermarks or watermark designs are visually enhanced, machine detectable or readable, or both, wherein the one or more enhanced watermarks or watermark designs comprises one or more transparent or translucent areas comprising one or more transparentizing materials surrounding each of the one or more enhanced watermarks or watermark designs.

4. A micro-optic film material comprising an arrangement of microlenses and an arrangement of micro-sized image icons, which are configured such that when the arrangement of image icons is viewed through the arrangement of microlenses, one or more synthetically magnified optical images are projected, wherein the micro-optic film material is made using only infrared-transparent materials, wherein the micro-optic film material demonstrates enhanced IR-brightness when measured in transmission.

5. A security sheet or document having one or more enhanced watermarks or watermark designs, which comprises:

a fibrous sheet material including one or more watermarks or watermark designs, wherein each watermark design has one or more first regions with reduced fiber densities relative to surrounding regions of the fibrous sheet material and one or more second regions with similar or increased fiber densities relative to surrounding regions of the sheet material, and wherein each watermark design has an upper or face portion and a lower or back portion; and one or more micro-optic film materials that at least partially cover the face or the back portion of the one or more watermark designs, wherein the one or more micro-optic film materials each comprise an arrangement of microlenses and an arrangement of micro-sized image icons, which are configured such that when the arrangement of image icons is viewed through the arrangement of microlenses, one or more synthetically magnified optical images are projected, wherein the one or more micro-optic film materials is made using one or more infrared-transparent elements and contains no infrared-absorbing elements, wherein the security sheet or document demonstrates enhanced IR-brightness when measured in transmission.

6. A micro-optic film material comprising an arrangement of microlenses and an arrangement of micro-sized image icons, which are configured such that when the arrangement of image icons is viewed through the arrangement of microlenses, one or more synthetically magnified optical images are projected, wherein the micro-optic film material is made using one or more infrared-transparent elements and contains no infrared-absorbing elements, wherein the micro-optic film material demonstrates enhanced IR-brightness when measured in transmission.

* * * * *